US011826588B2

(12) United States Patent
Jain et al.

(10) Patent No.: US 11,826,588 B2
(45) Date of Patent: Nov. 28, 2023

(54) METHODS AND APPARATUSES FOR PROVIDING FALL PROTECTION SYSTEMS

(71) Applicant: Honeywell International Inc., Charlotte, NC (US)

(72) Inventors: Ashish Jain, Charlotte, NC (US); Srivani Bayya, Charlotte, NC (US); Swapnil Patil, Charlotte, NC (US)

(73) Assignee: Honeywell International Inc., Charlotte, NC (US)

( * ) Notice: Subject to any disclaimer, the term of this patent is extended or adjusted under 35 U.S.C. 154(b) by 366 days.

(21) Appl. No.: 17/089,134

(22) Filed: Nov. 4, 2020

(65) Prior Publication Data

US 2021/0170207 A1 Jun. 10, 2021

(30) Foreign Application Priority Data

Nov. 21, 2019 (IN) ..... 201911047500

(51) Int. Cl.
*A62B 35/00* (2006.01)

(52) U.S. Cl.
CPC ..... *A62B 35/0018* (2013.01); *A62B 35/0037* (2013.01)

(58) Field of Classification Search
CPC ..... A62B 35/0018; A62B 35/0037
See application file for complete search history.

(56) References Cited

U.S. PATENT DOCUMENTS 5,957,091 A 9/1999 McDonald et al.
6,035,440 A * 3/2000 Woodyard ..... A41D 13/0007 2/102
8,292,029 B2 * 10/2012 Martin ..... A62B 35/0037 182/7
2007/0256890 A1 * 11/2007 Petzl ..... A62B 35/0018 182/3
2009/0078501 A1 * 3/2009 Mordecai ..... A41D 13/0007 182/7
2016/0322010 A1 11/2016 Amino
2016/0332010 A1 11/2016 Lowell

FOREIGN PATENT DOCUMENTS

JP 2008148803 A * 7/2008
JP 3159873 U 6/2010
WO 99/13947 A1 3/1999
WO 2008/001068 A1 1/2008

OTHER PUBLICATIONS

Extended European Search Report issued in European Application No. 20207054.6 dated Apr. 13, 2021, 8 pages.
First Examination Report issued in Indian Application No. 201911047500 dated Jun. 28, 2021.
Office Action received for European Application No. 20207054.6, dated Nov. 14, 2022, 9 pages.

* cited by examiner

*Primary Examiner* — Brian D Mattei
*Assistant Examiner* — Jacob G Sweeney
(74) *Attorney, Agent, or Firm* — Alston & Bird LLP

(57) ABSTRACT

Methods and apparatuses related to harnesses are provided. An example harness may include: a first leg strap comprising a first elongated member, a lower strap comprising a second elongated member, and an upper strap comprising a third elongated member.

8 Claims, 6 Drawing Sheets

METHODS AND APPARATUSES FOR PROVIDING FALL PROTECTION SYSTEMS

FIELD OF THE INVENTION

The present disclosure relates generally to methods and apparatuses for providing fall protection systems, and more particularly, to methods and apparatuses associated with full body harnesses.

BACKGROUND

Full body harnesses may be part of a personal fall arrest system (PFAS). "Fall arrest" refers to a form of fall protection that may safely stop a person who has fallen. In an example PFAS, a full body harness may be connected to an anchorage through a connecting device (e.g. lanyard, retractable lifeline, etc.). When a worker wearing a full body harness accidentally falls from, for example, a suspended scaffold that is ten feet above the working surface, the full body harness may prevent the worker from contacting the working surface and may minimize stress forces exerted on the worker during the fall. Additionally, or alternatively, full body harnesses may be part of a work positioning system. A work positioning system may allow a worker to be supported (in tension or suspension) on an elevated vertical surface (such as a telecom tower) by the full body harness connected to an anchorage through a connecting device.

However, existing harnesses are plagued by challenges and limitations. For example, many harnesses are difficult to wear due to complex configurations and complicated connections that may limit the range of movement. Many harnesses may require an excessive amount of time for donning, doffing, and size adjustment. As another example, many harnesses may be considerably heavy, which may exert unnecessary stress forces on the person wearing the harness.

BRIEF SUMMARY

In accordance with various embodiments of the present disclosure, an example harness may be provided. In some examples, the example harness may comprise a first leg strap, a lower strap, and an upper strap.

In some examples, a first end of the lower strap may be fastened to the first leg strap, and a second end of the lower strap may be fastened to a first thigh buckle plate. In some examples, a first end of the upper strap may be fastened to a ventral plate, and a second end of the upper strap may be fastened to a second thigh buckle plate. In some examples, the first thigh buckle plate and the second thigh buckle plate may form a thigh buckle that connects the upper strap and the lower strap.

For example, the first leg strap may comprise a first elongated member, the lower strap may comprise a second elongated member, and the upper strap may comprise a third elongated member. In some examples, a first end of the second elongated member may be fastened to a first side of the first elongated member. In some examples, a second end of the second elongated member may be fastened to a first thigh buckle plate through a slot of the first thigh buckle plate. In some examples, a first end of the third elongated member may be fastened to a ventral plate through a first slot of the ventral plate. In some examples, a second end of the third elongated member may be fastened to a second thigh buckle plate through a slot of the second thigh buckle plate.

In some examples, the thigh buckle may be at least one of a pass-through buckle or a quick connect buckle.

In some examples, a first end of the first leg strap may be fastened to a first leg buckle plate, and a second end of the first leg strap may be fastened to a second leg buckle plate. In some examples, the first leg buckle plate and the second leg buckle plate may form a leg buckle connecting the first end and the second end of the first leg strap.

For example, a first end of the first elongated member may be fastened to a first leg buckle plate through a slot of the first leg buckle plate. In some examples, a second end of the first elongated member may be fastened to a second leg buckle plate through a slot of the second leg buckle plate.

In some examples, the upper strap may comprise a loop at the first end of the upper strap. In some examples, the harness may further comprise a waist belt. In some examples, a first end of the waist belt may be fastened to a first waist buckle plate, and a second end of the waist belt may be fastened to a second waist buckle plate. In some examples, the first waist buckle plate and the second waist buckle plate may form a waist buckle connecting the first end and the second end of the waist belt through the loop of the upper strap.

For example, the waist belt may comprise a fourth elongated member. In some examples, a first end of the fourth elongated member may be fastened to a first waist buckle plate through a slot of the first waist buckle plate. In some examples, a second end of the fourth elongated member may be fastened to a second waist buckle plate through a slot of the second waist buckle plate. In some examples, the first waist buckle plate and the second waist buckle plate may form a waist buckle connecting the first end and the second end of the fourth elongated member through the loop of the upper strap.

In some examples, the harness may further comprise an abdomen strap. In some examples, a first end of the abdomen strap may be fastened to the ventral plate and a second end of the abdomen strap may be fastened to a sternal plate.

For example, the abdomen strap may comprise a fifth elongated member. In some examples, a first end of the fifth elongated member may be fastened to the ventral plate through a second slot of the ventral plate. In some examples, a second end of the fifth elongated member may be fastened to a sternal plate through a first slot of the sternal plate.

In some examples, the harness may further comprise a chest strap passing through the sternal plate. In some examples, a first end of the chest strap may be fastened to a first shoulder buckle plate, and a second end of the chest strap may be fastened to a second shoulder buckle plate.

For example, the chest strap may comprise a sixth elongated member passing through a second slot of the sternal plate. In some examples, a first end of the sixth elongated member may be fastened to a first shoulder buckle plate through a slot of the first shoulder buckle plate. In some examples, a second end of the sixth elongated member may be fastened to a second shoulder buckle plate through a slot of the second shoulder buckle plate.

In some examples, the harness may further comprise a first shoulder strap. In some examples, a first end of the first shoulder strap may be fastened to a third shoulder buckle plate, and a second end of the first shoulder strap may be fastened to the first leg strap. In some examples, the first shoulder buckle plate and the third shoulder buckle plate may form a first shoulder buckle connecting the chest strap and the first shoulder strap.

For example, the first shoulder strap may comprises a seventh elongated member. In some examples, a first end of the seventh elongated member may be fastened to a third shoulder buckle plate through a slot of the third shoulder buckle plate. In some examples, a second end of the seventh elongated member may be fastened to the first elongated member. In some examples, the first shoulder buckle plate and the third shoulder buckle plate may form a first shoulder buckle connecting the chest strap and the first shoulder strap.

In some examples, the harness may further comprise a second leg strap and a second shoulder strap. In some examples, a first end of the second shoulder strap may be fastened to a fourth shoulder buckle plate, and a second end of the second shoulder strap may be fastened to the second leg strap. In some examples, the second shoulder buckle plate and the fourth shoulder buckle plate may form a second shoulder buckle connecting the chest strap and the second shoulder strap.

For example, the second leg strap may comprise an eighth elongated member. In some examples, the second shoulder strap may comprise a ninth elongated member. In some examples, a first end of the ninth elongated member may be fastened to a fourth shoulder buckle plate through a slot of the fourth shoulder buckle plate. In some examples, a second end of the ninth elongated member may be fastened to the eighth elongated member. In some examples, the second shoulder buckle plate and the fourth shoulder buckle plate may form a second shoulder buckle connecting the chest strap and the second shoulder strap.

In some examples, the harness may further comprise a three-way plate, a second leg strap, and a thigh strap. In some examples, the three-way plate may comprise a first slot, a second slot, and a third slot. In some examples, a first end of the second leg strap may be fastened to the three-way plate through the first slot, and a second end of the second leg strap may be fastened to the three-way plate through the second slot. In some examples, a first end of the thigh strap may be fastened to the ventral plate, and a second end of the thigh strap may be fastened to the three-way plate through the third slot of the three-way plate.

In some examples, the harness may further comprise a thigh strap and a second leg strap. In some examples, a first end of the thigh strap may be fastened to the ventral plate, and a second end of the thigh strap may comprise a loop. In some examples, a first end of the second leg strap may be fastened to a first leg buckle plate, and a second end of the first leg strap may be fastened to a second leg buckle plate. In some examples, the first leg buckle plate and the second leg buckle plate may form a leg buckle connecting the first end and the second end of the second leg strap through the loop of the thigh strap.

The foregoing illustrative summary, as well as other exemplary objectives and/or advantages of the disclosure, and the manner in which the same are accomplished, are further explained in the following detailed description and its accompanying drawings.

BRIEF DESCRIPTION OF THE DRAWINGS

The description of the illustrative embodiments may be read in conjunction with the accompanying figures. It will be appreciated that, for simplicity and clarity of illustration, elements illustrated in the figures have not necessarily been drawn to scale, unless described otherwise. For example, the dimensions of some of the elements may be exaggerated relative to other elements, unless described otherwise. Embodiments incorporating teachings of the present disclosure are shown and described with respect to the figures presented herein, in which.

DETAILED DESCRIPTION OF THE INVENTION

Figure 1A:
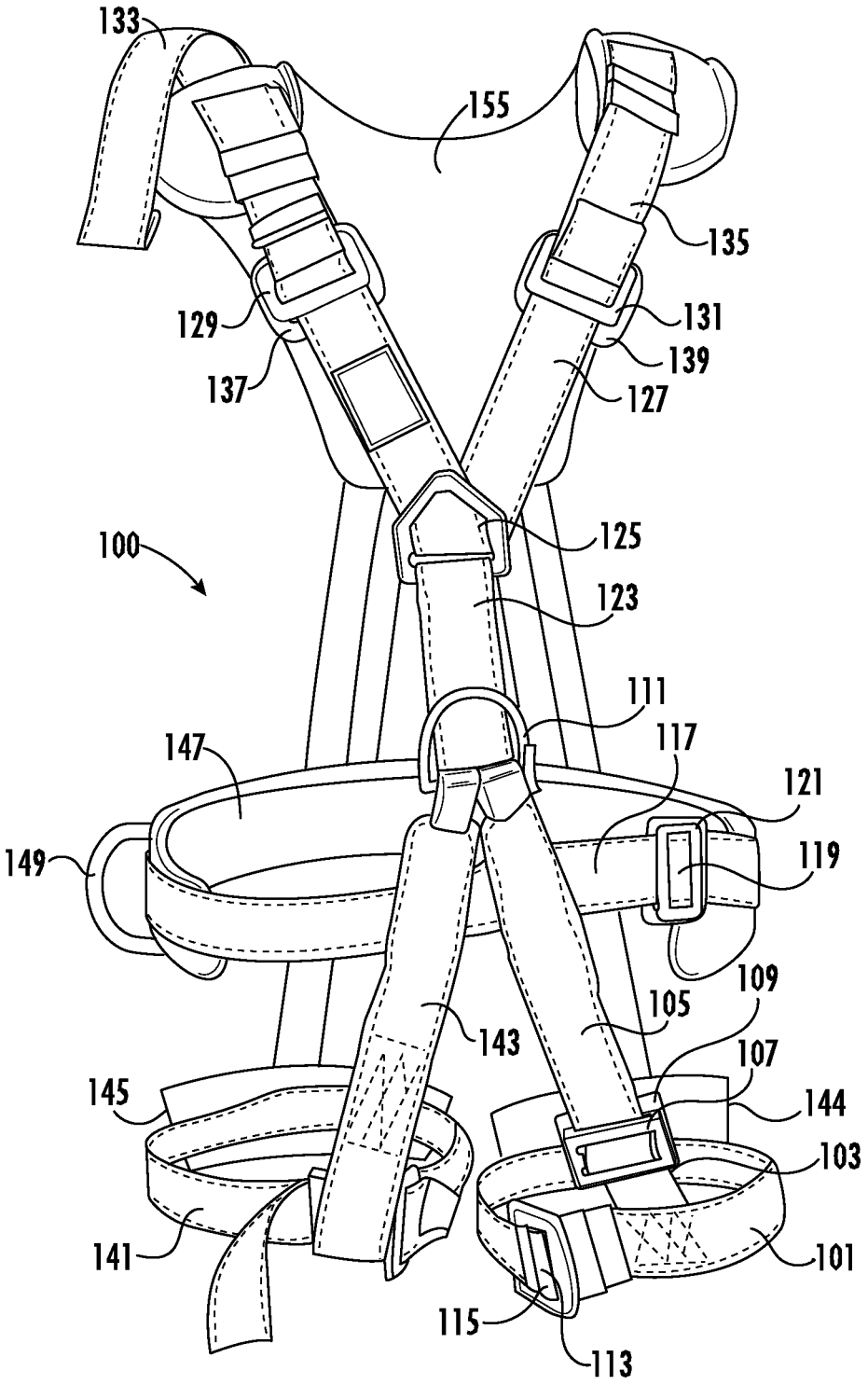
FIG. 1A illustrates an example view of an example apparatus in accordance with various embodiments of the present disclosure.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout.

The phrases "in one embodiment," "according to one embodiment," "in some examples," and the like generally mean that the particular feature, structure, or characteristic following the phrase may be included in at least one embodiment of the present disclosure and may be included in more than one embodiment of the present disclosure (importantly, such phrases do not necessarily refer to the same embodiment).

If the specification states a component or feature "may," "can," "could," "should," "would," "preferably," "possibly," "typically," "optionally," "for example," "as an example," "in some examples," "often," or "might" (or other such language) be included or have a characteristic, that specific component or feature is not required to be included or to have the characteristic. Such component or feature may be optionally included in some embodiments, or it may be excluded.

The word "example" or "exemplary" is used herein to mean "serving as an example, instance, or illustration." Any implementation described herein as "exemplary" is not necessarily to be construed as preferred or advantageous over other implementations.

The term "strap" refers to an elongated flap or a flat strip comprising a material having flexibility characteristics. Example material may include, but not limited to, nylon, polyester, synthetic fiber, and/or the like. In some examples, an example strap may connect, fasten, and/or secure various parts of an example harness, and/or may support body portion(s) of a wearer of the example harness.

In some examples, an example strap of an example harness may be referred in connection with an example placement of the strap when the example harness is worn by a user. For example, an example leg strap of an example harness may be placed on a leg portion of a wearer of the example harness. As another example, an example abdomen strap of an example harness may be placed on an abdomen portion of a wearer of the example harness. However, it is noted that the scope of the present disclosure is not limited to placing straps on these specific portions of a wearer as referred, and such straps may be placed on other portions of a wearer without deviating from the scope of the present disclosure.

The term "buckle" refers to a device that may create a secured arrangement between loose ends (such as loose ends of one or more straps) in an adjustable manner such that these loose ends may also be disconnected when the buckle is released. In some examples, a buckle may comprise material having sturdy characteristics, such as, but not limited to, nickel, brass, zinc, steel, and/or the like.

In some examples, a buckle may comprise a first portion and a second portion. For example, a first portion of an example buckle may be connected to a first loose end of a strap, and a second portion of the example buckle may be connected to a second loose end of the same strap or a different strap. The first portion and the second portion may form the buckle that connects the first loose end and the second loose end.

In various examples of the present disclose, buckles may be in various forms and/or various shapes. For example, an example buckle may be a pass-through buckle, where a first portion of the buckle may comprise a first metal plate and a second portion of the buckle may comprise a second metal plate. The first metal plate may be connected to a first loose end, and the second metal plate may be connected to a second loose end. When the first metal plate passed through the second metal plate, a secured connection between the first loose end and the second loose end may be formed when the first loose end and the second lose end are pulled away from each other.

As another example, an example buckle may be a quick connect buckle. For example, a first portion of an example quick connect buckle may comprise a center strip, and a second portion of the buckle may comprise an opening that may receive and secure the center strip. For example, the center strip of the first portion may comprise a retaining block at a front end, and the retaining block may extend from the rest of the center strip in a perpendicular direction of a center axis of the center strip. When the center strip is inserted to the opening of the second portion, the second portion may receive and secure the retaining block through one or more spring components.

Additionally, or alternatively, other types of buckles may be used in accordance with various examples of the present disclosure, including, but not limited to, cam buckles, roller buckles, belt buckles, and/or the like.

In some examples, an example buckle of an example harness may be referred in connection with an example placement of the example buckle when the example harness is worn by a user. For example, an example leg buckle of an example harness may be placed on a leg portion of a wearer of the example harness and may connect loose ends of a leg strap. As another example, an example thigh buckle of an example harness may be placed on a thigh portion of a wearer of the example harness, and may connect loose ends of an upper strap and a lower strap. However, it is noted that the scope of the present disclosure is not limited to placing buckles on these specific portions of a wearer as referred, and such buckles may be placed on other portions of a wearer without deviating from the scope of the present disclosure.

The term "plate" refers to a slab of material having sturdy characteristics, such as, but not limited to, nickel, brass, zinc, steel, and/or the like. In some examples, material having sturdy characteristics may not bend or deform under a certain weight, and/or may resist fracturing when force is applied. As such, they may securely fasten various components of a harness.

In various examples of the present disclosure, an example plate may create a secured arrangement between one or more loose ends. For example, an example plate may comprise one or more slots or openings, and each of one or more example straps may pass through the slot(s) or opening (s) and then be stitched back on the example strap, thereby creating one or more loops that are bonded to the example plate. Additionally, or alternatively, other fastening mechanisms may be used to fasten the example strap(s) to the example plate, such as, but not limited to, through an adhesive material (e.g. fabric glue).

In some examples, an example plate of an example harness may be referred in connection with an example placement of the example plate when the example harness is worn by a user. For example, an example ventral plate of an example harness may be placed on a ventral portion of a wearer of the example harness, and may connect loose ends of an upper strap and an abdomen strap. As another example, an example sternal strap of an example harness may be placed on a sternal portion of a wearer of the example harness, and may fasten a loose end of an abdomen strap to a chest strap. However, it is noted that the scope of the present disclosure is not limited to placing plates on these specific portions of a wearer as referred, and such plates may be placed on other portions of a wearer without deviating from the scope of the present disclosure.

As described above, harnesses are plagued by challenges and limitations. For example, many harnesses may require an excessive amount of donning, doffing, and size adjustment. As another example, many harnesses may exert stress force on the person wearing the harness.

To address these challenges and limitations, an example harness in accordance with examples of the present disclosure may comprise an upper strap and a lower strap that may connect/disconnect the leg strap with the front portion of the harness, and therefore may enable user-friendly side donning and doffing when wearing the harness. Additionally, or alternatively, an example harness in accordance with examples of the present disclosure may include a single waist buckle on the waist belt, which may allow quick and easy adjustment of the example harness.

As such, various examples of the present disclosure may reduce the time required to wear the harness, improve the usability and ergonomics of the harness, improve the productivity of the worker wearing the harness, and/or improve the overall safety protection for the worker.

Figure 1B:
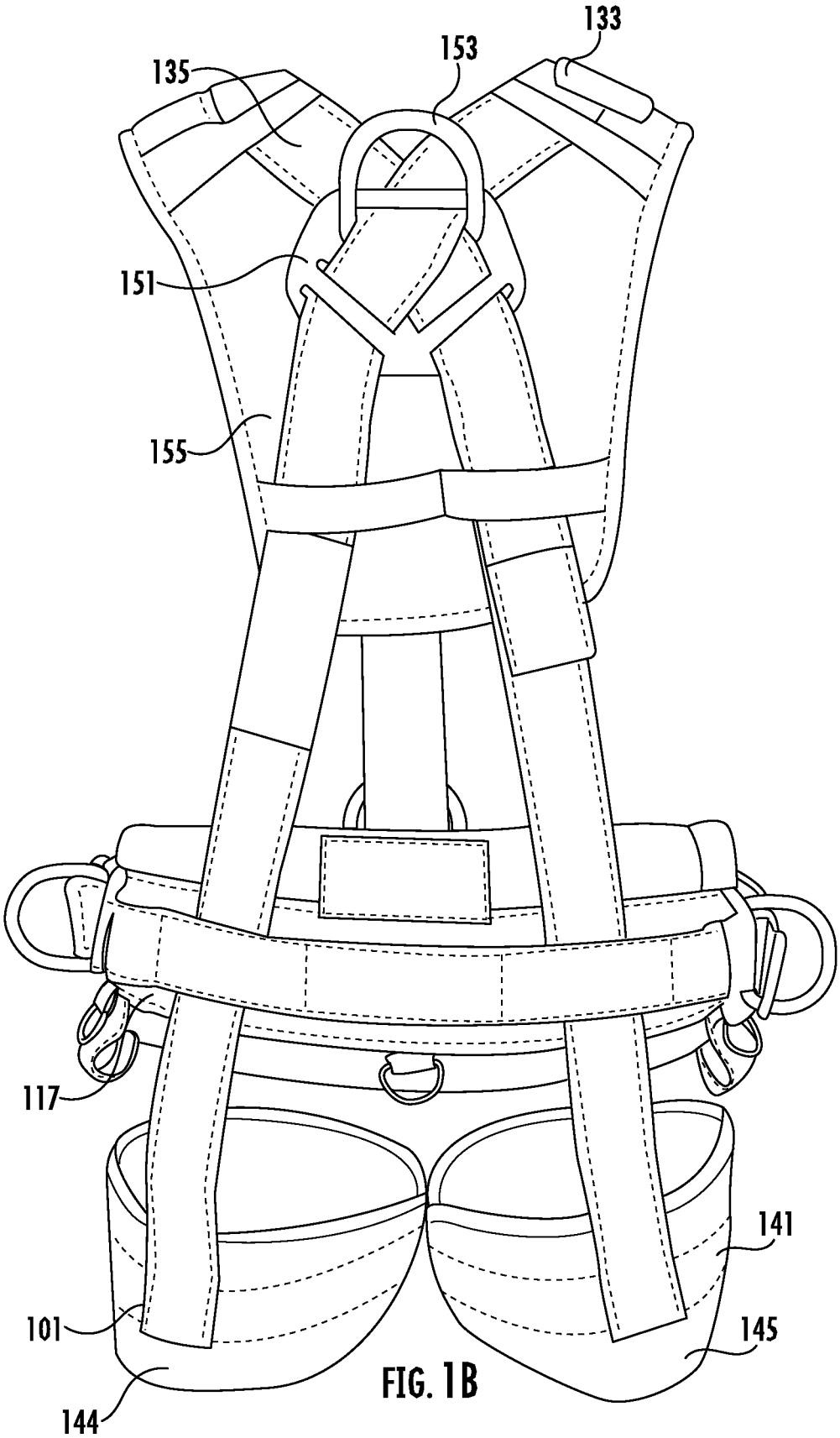
FIG. 1B illustrates an example view of an example apparatus in accordance with various embodiments of the present disclosure.
Figure 1C:
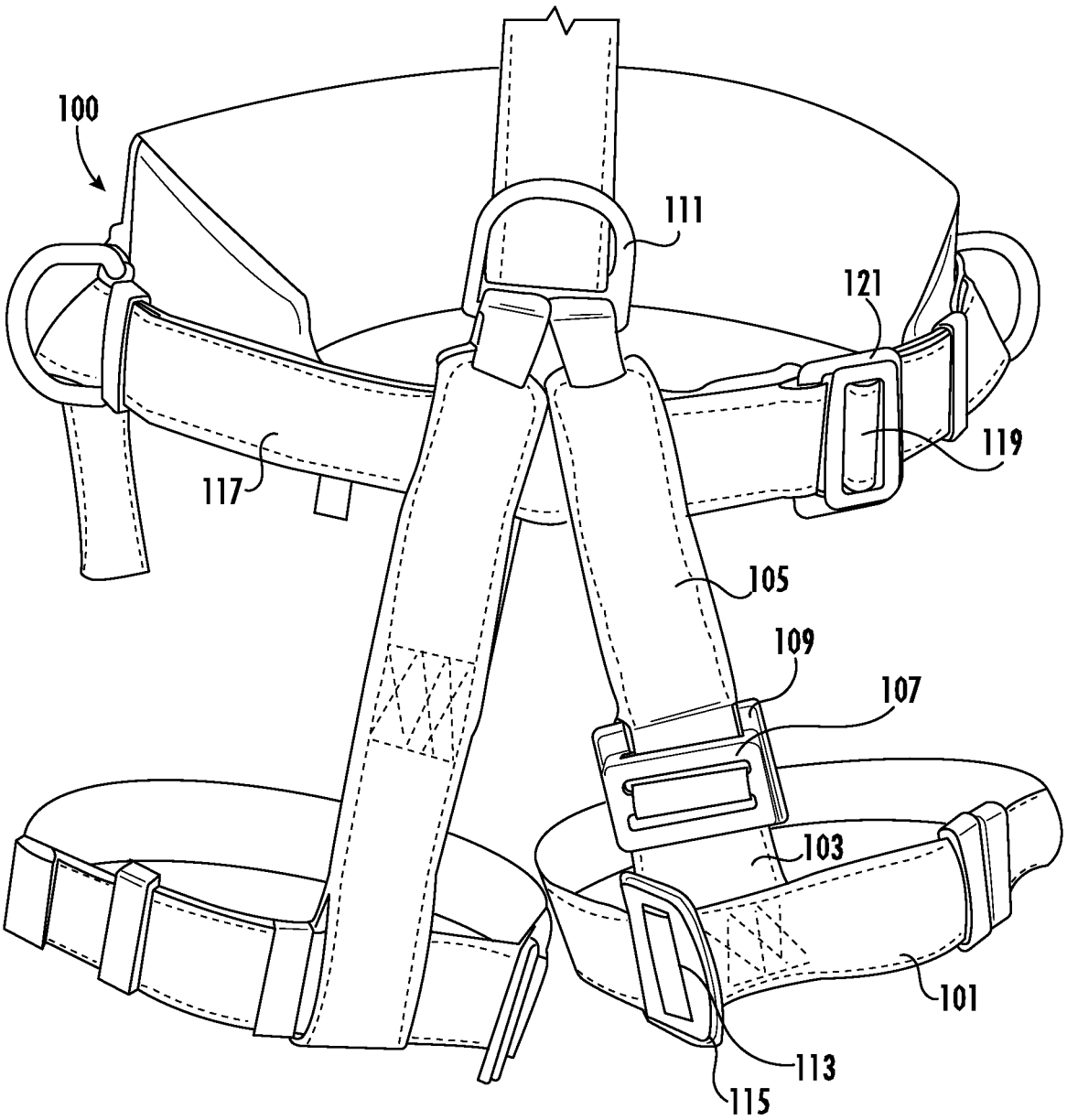
FIG. 1C illustrates an example view of an example apparatus in accordance with various embodiments of the present disclosure.

Referring now to FIG. 1A, FIG. 1B, and FIG. 1C, various example views of an example apparatus in accordance with various embodiments of the present disclosure are shown. In the example shown in FIG. 1A, FIG. 1B, and FIG. 1C, the example apparatus may take the form of an example harness 100. In some examples, the example harness 100 may comprise a first leg strap 101, a lower strap 103, and an upper strap 105.

As described above, the first leg strap 101 may be placed on a leg portion of a wearer of the example harness 100. For example, the first leg strap 101 may be configured to form a loop so that the wearer can put his leg through the first leg strap 101, and therefore the wearer's leg position may be secured when the first leg strap 101 is worn. For example, the first leg strap 101 may comprise an elongated member made of material having flexibility characteristics, such as, but is not limited to, nylon, polyester, synthetic fiber, and/or the like. When a user intends to put on the harness, the user may put his leg through the first leg strap 101, and secure or fasten ends of the first leg strap 101, details of which are described herein. The first leg strap 101 may secure the position of the user's leg in relationship to other components of the example harness 100.

In the example shown in FIG. 1A, the lower strap 103 may comprise an elongated member. In some examples, a first end of the lower strap 103 may be fastened to a first side of the first leg strap 101. For example, the first end of the lower strap 103 may be stitched on the first leg strap 101. Additionally, or alternatively, the first end of the lower strap 103 may comprise a loop that allows the first leg strap 101 to pass through. Additionally, or alternatively, other fastening mechanisms may be used to fasten the first end of the lower strap 103 to the first leg strap 101, such as, but not limited to, through an adhesive material (e.g. fabric glue).

In some examples, a second end of the lower strap 103 may be fastened to a first thigh buckle plate 107. For example, the first thigh buckle plate 107 may comprise a first metal plate having two slots divided by a middle bar portion. The second end of the lower strap 103 may pass through the two slots and may be stitched back on the lower strap 103 to create a loop, where the middle bar portion of the first metal plate may be disposed in the loop. Additionally, or alternatively, the first thigh buckle plate 107 may be in other forms, such as those described above. Additionally, or alternatively, other fastening mechanisms may be used to fasten the second end of the lower strap 103 to the first thigh buckle plate 107, such as, but not limited to, through an adhesive material (e.g. fabric glue).

In the example shown in FIG. 1A, the upper strap 105 may comprise an elongated member. In some examples, a first end of the upper strap 105 may be fastened to a ventral plate 111. In some examples, the ventral plate 111 may be positioned on a ventral portion of a user when the user wears the example harness 100. For example, the ventral plate 111 may comprise one or more slots, and the first end of the upper strap 105 may comprise a carabiner that can be connected to one of the slots. Additionally, or alternatively, the first end of the upper strap 105 may comprise a connector that is fastened to the one of the slots of the ventral plate 111. Additionally, or alternatively, the first end of the upper strap 105 may pass through one or more of the slots and may be stitched back on the upper strap 105, thereby creating a loop that is bonded to the ventral plate 111. Additionally, or alternatively, other fastening mechanisms may be used to fasten the example strap to the plate, such as, but not limited to, through an adhesive material (e.g. fabric glue).

In some examples, a second end of the upper strap 105 may be fastened to a second thigh buckle plate 109. For example, the second thigh buckle plate 109 may comprise a second metal plate having two or more slots. The second end of the upper strap 105 may pass through one of the slots and may be stitched back on the upper strap 105 to create a loop bonded to the second thigh buckle plate 109. Additionally, or alternatively, the second thigh buckle plate 109 may be in other forms, such as those described above. Additionally, or alternatively, other fastening mechanisms may be used to fasten the second end of the upper strap 105 to the second thigh buckle plate 109, such as, but not limited to, through an adhesive material (e.g. fabric glue).

In the example shown in FIG. 1A, the first thigh buckle plate 107 and the second thigh buckle plate 109 may form a thigh buckle that connects the upper strap 105 and the lower strap 103. The thigh buckle may be in various forms, including, but not limited to, a pass-through buckle, a quick connect buckle, a cam buckle, a roller buckle, and/or a belt buckle as described above.

In some examples, a first end of the first leg strap 101 may be fastened to a first leg buckle plate 113, and a second end of the first leg strap 101 may be fastened to a second leg buckle plate 115. For example, the first leg buckle plate 113 may comprise one or more slots or openings, and a first end of the first leg strap 101 may pass through one or more of the slots or openings and may be stitched back on the first leg strap 101, thereby creating a loop that is bonded to the first leg buckle plate 113. Additionally, or alternatively, the first leg buckle plate 113 may be in other forms, such as those described above. Additionally, or alternatively, other fastening mechanisms may be used to fasten the first end of the first leg strap 101 to the first leg buckle plate 113, such as, but not limited to, through an adhesive material (e.g. fabric glue). In some examples, the second end of the first leg strap 101 may be similarly fastened to the second leg buckle plate 115.

In some examples, the first leg buckle plate 113 and the second leg buckle plate 115 may form a leg buckle that connects the first end and the second end of the first leg strap 101. The leg buckle may be in various forms, including but not limited to, a pass-through buckle, a quick connect buckle, a cam buckle, a roller buckle, and/or a belt buckle as described above.

Additionally, or alternatively, the example harness 100 may comprise a second leg strap 141. Similar to the first leg strap 101 described above, the second leg strap 141 may comprise an elongated member, and may have a first end and a second end that may be connected through a buckle (e.g. a pass-through buckle, a quick connect buckle, a cam buckle, a roller buckle, and/or a belt buckle as described above).

Additionally, or alternatively, the example harness 100 may comprise a thigh strap 143. The thigh strap 143 may comprise an elongated member. In the example shown in FIG. 1A, a first end of the thigh strap 143 may be fastened to the ventral plate 111, similar to those described above in connection with the first end of the upper strap 105. Additionally, or alternatively, a second end of the thigh strap 143 may be connected to the second leg strap 141. For example, the second end of the thigh strap 143 may comprise a loop that allows the second leg strap 141 to pass through. Additionally, or alternatively, the second end of the thigh strap 143 may be stitched to the second leg strap 141. Additionally, or alternatively, the second end of the thigh strap 143 may be fastened to the second leg strap 141 through an adhesive material (e.g. fabric glue).

Additionally, or alternatively, the example harness 100 may comprise one or more leg pads, such as a first leg pad 144 and a second leg pad 145. In some examples, the first leg pad 144 may be retained to the first leg strap 101 through, for example, one or more loops. In some examples, the second leg pad 145 may be retained to the second leg strap 141 through, for example, one or more loops. In some examples, the first leg pad 144 and/or the second leg pad 145 may comprise material having shock-absorbing characteristics, including, but not limited to, cotton, polymers, silicon, and/or the like. Additional details of the first leg pad 144 and the second leg pad 145 are illustrated and described in connection with at least FIG. 1B.

In the example shown in FIG. 1A, the example harness 100 may comprise a waist belt 117. The waist belt may comprise an elongated member. In some examples, the upper strap 105 may comprise a loop at it first end, such that the waist belt 117 may pass through the loop in the upper strap 105. Additionally, or alternatively, the thigh strap 143 may comprise a loop at its first end, such that the waist belt 117 may pass through the loop in the thigh strap 143.

In some examples, a first end of the waist belt 117 may be fastened to a first waist buckle plate 119, and a second end of the waist belt 117 may be fastened to a second waist buckle plate 121. For example, the first waist buckle plate 119 may comprise one or more slots or openings, and a first end of the waist belt 117 may pass through one or more of the slots or openings and may be stitched back on the waist belt 117, thereby creating a loop that is bonded to the first waist buckle plate 119. Additionally, or alternatively, the first waist buckle plate 119 may be in other forms, such as those described above. Additionally, or alternatively, other fastening mechanisms may be used to fasten the first end of the waist belt 117 to the first waist buckle plate 119, such as, but not limited to, through an adhesive material (e.g. fabric glue). In some examples, the second end of the waist belt 117 may be similarly fastened to the second waist buckle plate 121.

In some examples, the first waist buckle plate 119 and the second waist buckle plate 121 may form a waist buckle that connects the first end and the second end of the waist belt 117 through the loop of the upper strap 105 and/or the loop of the thigh strap 143. The waist buckle may be in various forms, including but not limited to, a pass-through buckle, a quick connect buckle, a cam buckle, a roller buckle, and/or a belt buckle as described above.

Additionally, or alternatively, the example harness 100 may comprise one or more waist pad, such as a waist pad 147. In some examples, the waist pad 147 may be retained to the waist belt 117 through, for example, one or more loops. In some examples, the waist pad 147 may comprise material having shock-absorbing characteristics, including, but not limited to, cotton, polymers, silicon, and/or the like. Additional details of the waist pad 147 are illustrated and described in connection with at least FIG. 1B.

Additionally, or alternatively, the example harness 100 may comprise one or more D-rings, such as D-ring 149 fastened to the waist belt 117. The D-ring 149 may be in a shape similar to a capitalized letter D in the English alphabet, and may comprise material having sturdy characteristics, such as, but not limited to, nickel, brass, zinc, steel, and/or the like. The D-ring 149 may be connected to, for example, a lanyard or a retractable lifeline, which may in turn be connected to an anchorage. Additionally, or alternatively, one or more D-rings may be fastened to other parts of the example harness 100, such as, but not limited to, the ventral plate 111 and/or the sternal plate 125.

In the example shown in FIG. 1A, the example harness 100 may comprise an abdomen strap 123. The abdomen strap 123 may comprise an elongated member. In some examples, a first end of the abdomen strap 123 may be fastened to the ventral plate 111, and a second end of the abdomen strap 123 may be fastened to a sternal plate 125. For example, the sternal plate 125 may comprise one or more slots or openings, and a second end of the abdomen strap 123 may pass through one or more of the slots or openings and may be stitched back on the abdomen strap 123, thereby creating a loop that is bonded to the sternal plate 125. Additionally, or alternatively, other fastening mechanisms may be used to fasten the second end of the abdomen strap 123 to the sternal plate 125, such as, but not limited to, through an adhesive material (e.g. fabric glue). In some examples, the first end of the abdomen strap 123 may be similarly fastened to the ventral plate 111.

In the example shown in FIG. 1A, the example harness 100 may comprise a chest strap 127. The chest strap 127 may comprise an elongated member. In some examples, the chest strap 127 may pass through slots or openings of the sternal plate 125. For example, the sternal plate 125 may comprise two slots divided by a bar portion. The chest strap 127 may pass through the two slots to create a loop, and the bar portion of the sternal plate 125 may be disposed in the loop created by the chest strap 127.

In some examples, a first end of the chest strap 127 may be fastened to a first shoulder buckle plate 129, and a second end of the chest strap 127 may be fastened to a second shoulder buckle plate 131. For example, the first shoulder buckle plate 129 may comprise one or more slots or openings, and a first end of the chest strap 127 may pass through one or more of the slots or openings and may be stitched back on the chest strap 127, thereby creating a loop that is bonded to the first shoulder buckle plate 129. Additionally, or alternatively, the first shoulder buckle plate 129 may be in other forms, such as those described above. Additionally, or alternatively, other fastening mechanisms may be used to fasten the first end of the chest strap 127 to the first shoulder buckle plate 129, such as, but not limited to, through an adhesive material (e.g. fabric glue). In some examples, the second end of the chest strap 127 may be similarly fastened to a second shoulder buckle plate 131.

In the example shown in FIG. 1A, the example harness 100 may comprise a first shoulder strap 133. The first shoulder strap 133 may comprise an elongated member. In some examples, a first end of the first shoulder strap 133 may be fastened to a third shoulder buckle plate 137. For example, the third shoulder buckle plate 137 may comprise one or more slots or openings, and the first end of the first shoulder strap 133 may pass through one or more of the slots or openings and may be stitched back on the first shoulder strap 133, thereby creating a loop that is bonded to the third shoulder buckle plate 137. Additionally, or alternatively, other fastening mechanisms may be used to fasten the first end of the first shoulder strap 133 to the third shoulder buckle plate 137, such as, but not limited to, through an adhesive material (e.g. fabric glue).

In some examples, the first shoulder buckle plate 129 and the third shoulder buckle plate 137 may form a first shoulder buckle that connects the chest strap 127 and the first shoulder strap 133. The first shoulder buckle may be in various forms, including, but not limited to, a pass-through buckle, a quick connect buckle, a cam buckle, a roller buckle, and/or a belt buckle as described above.

In some examples, a second end of the first shoulder strap 133 may be connected to the first leg strap 101. For example, the second end of the first shoulder strap 133 may comprise a loop that allows the first leg strap 101 to pass through. Additionally, or alternatively, the second end of the first shoulder strap 133 may be stitched to the first leg strap 101. Additionally, or alternatively, the second end of the first shoulder strap 133 may be fastened to the first leg strap 101 through an adhesive material (e.g. fabric glue).

In the example shown in FIG. 1A, the example harness 100 may comprise a second shoulder strap 135. The second shoulder strap 135 may comprise an elongated member. In some examples, a first end of the second shoulder strap 135 may be fastened to a fourth shoulder buckle plate 139. For example, the fourth shoulder buckle plate 139 may comprise one or more slots or openings, and a first end of the second shoulder strap 135 may pass through one or more of the slots or openings and may be stitched back on the second shoulder strap 135, thereby creating a loop that is bonded to the fourth shoulder buckle plate 139. Additionally, or alternatively, other fastening mechanisms may be used to fasten the first end of the second shoulder strap 135 to the fourth shoulder buckle plate 139, such as, but not limited to, through an adhesive material (e.g. fabric glue).

In some examples, the second shoulder buckle plate 131 and the fourth shoulder buckle plate 139 may form a second shoulder buckle that connects the chest strap 127 and the second shoulder strap 135. The second shoulder buckle may be in various forms, including, but not limited to, a pass-through buckle, a quick connect buckle, a cam buckle, a roller buckle, and/or a belt buckle as described above.

In some examples, a second end of the second shoulder strap 135 may be connected to the second leg strap 141. For example, the second end of the second shoulder strap 135 may comprise a loop that allows the second leg strap 141 to pass through. Additionally, or alternatively, the second end of the second shoulder strap 135 may be stitched to the second leg strap 141. Additionally, or alternatively, the second end of the second shoulder strap 135 may be fastened to the second leg strap 141 through an adhesive material (e.g. fabric glue).

Referring now to FIG. 1B, an example view of the example harness 100 is provided.

In the example shown in FIG. 1B, the example harness 100 may comprise a back pad 155. The back pad 155 may comprise material having shock-absorbing characteristics, including, but not limited to, cotton, polymers, silicon, and/or the like. In some examples, the first shoulder strap 133 and/or the second shoulder strap 135 may be retained on the back pad 155 through, for example, one or more loops.

In some examples, the example harness 100 may comprise a back plate 151 secured on the back pad 155. In some examples, the first shoulder strap 133 and/or the second shoulder strap 135 may pass through one or more slots of the back plate 151.

In some examples, the example harness 100 may comprise a D-ring 153 fastened to the back plate 151. The D-ring 153 may be in a shape similar to a capitalized letter D in the English alphabet, and may comprise material having sturdy characteristics, such as, but not limited to, nickel, brass, zinc, steel, and/or the like. The D-ring 153 may be connected to, for example, a lanyard or a retractable lifeline, which may in turn be connected to an anchorage.

In the example shown in FIG. 1B, the first shoulder strap 133 and/or the second shoulder strap 135 may pass through one or more loops on the waist belt 117. As described above, the second end of the first shoulder strap 133 may be connected to the first leg strap 101, and the second end of the second shoulder strap 135 may be connected to the second leg strap 141.

Referring now to FIG. 1C, another view of the example harness 100 is shown. In particular, FIG. 1C illustrates an example partial view of the example harness 100, including at least the first leg strap 101, the lower strap 103, and the upper strap 105.

In some examples, when the example harness 100 is not in use, the first thigh buckle plate 107 may be disconnected from the second thigh buckle plate 109. Additionally, or alternatively, the first leg buckle plate 113 may be disconnected from the second leg buckle plate 115. In such example, when a user attempts to wear the example harness 100, the user may slip the example harness 100 over his shoulders, connect the first waist buckle plate 119 with the second waist buckle plate 121, connect the first leg buckle plate 113 with the second leg buckle plate 115, and then connect the first thigh buckle plate 107 with the second thigh buckle plate 109. As such, the example harness 100 may reduce or eliminate the need for excessive donning, doffing, and/or size adjustment as compared to other harnesses. In some examples, putting on an example harness in accordance with examples of the present disclosure may reduce the time by 34.24% as compared to the time required for putting on other harnesses.

Figure 2A:
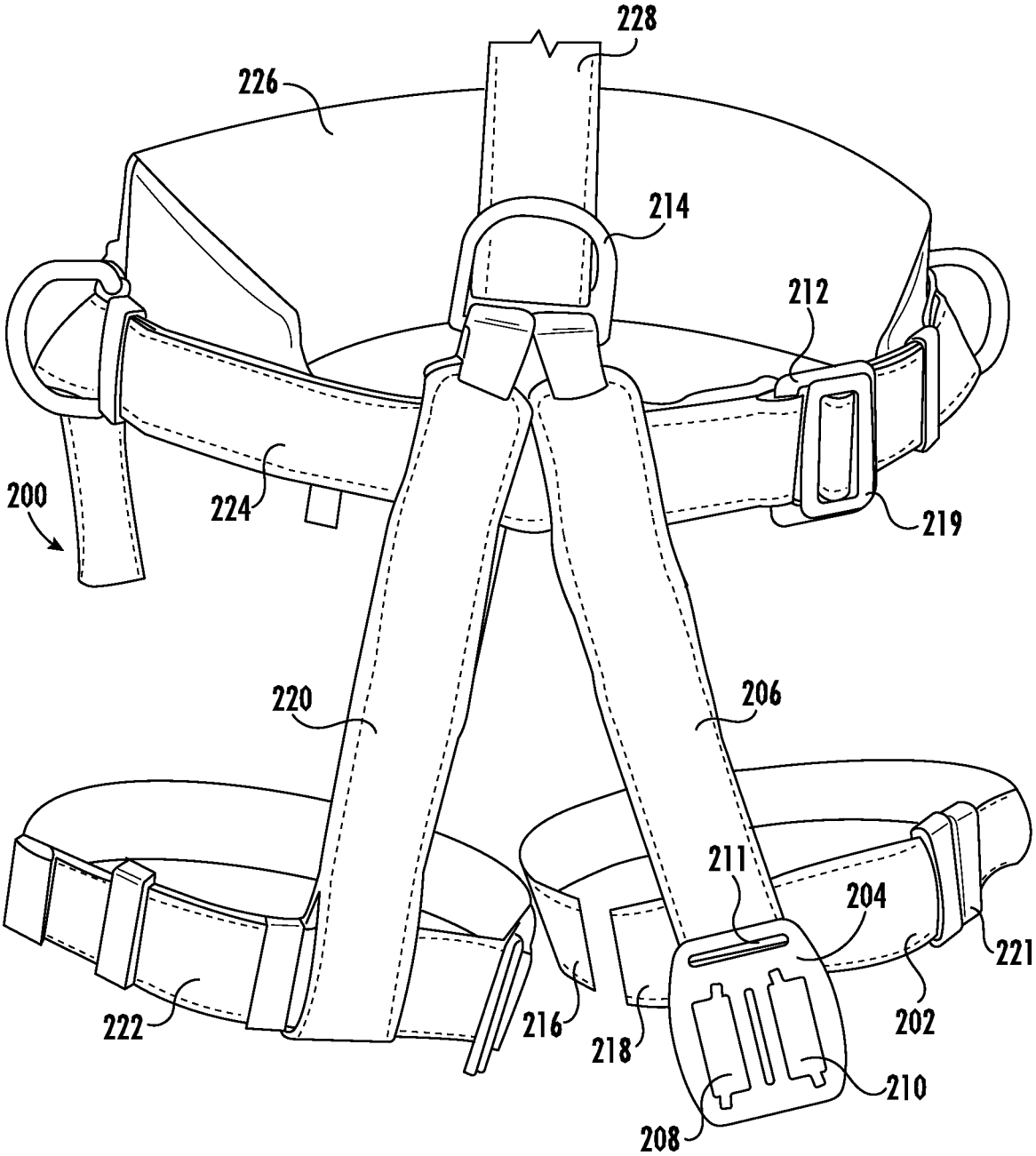
FIG. 2A illustrates an example view of an example apparatus in accordance with various embodiments of the present disclosure.
Figure 2B:
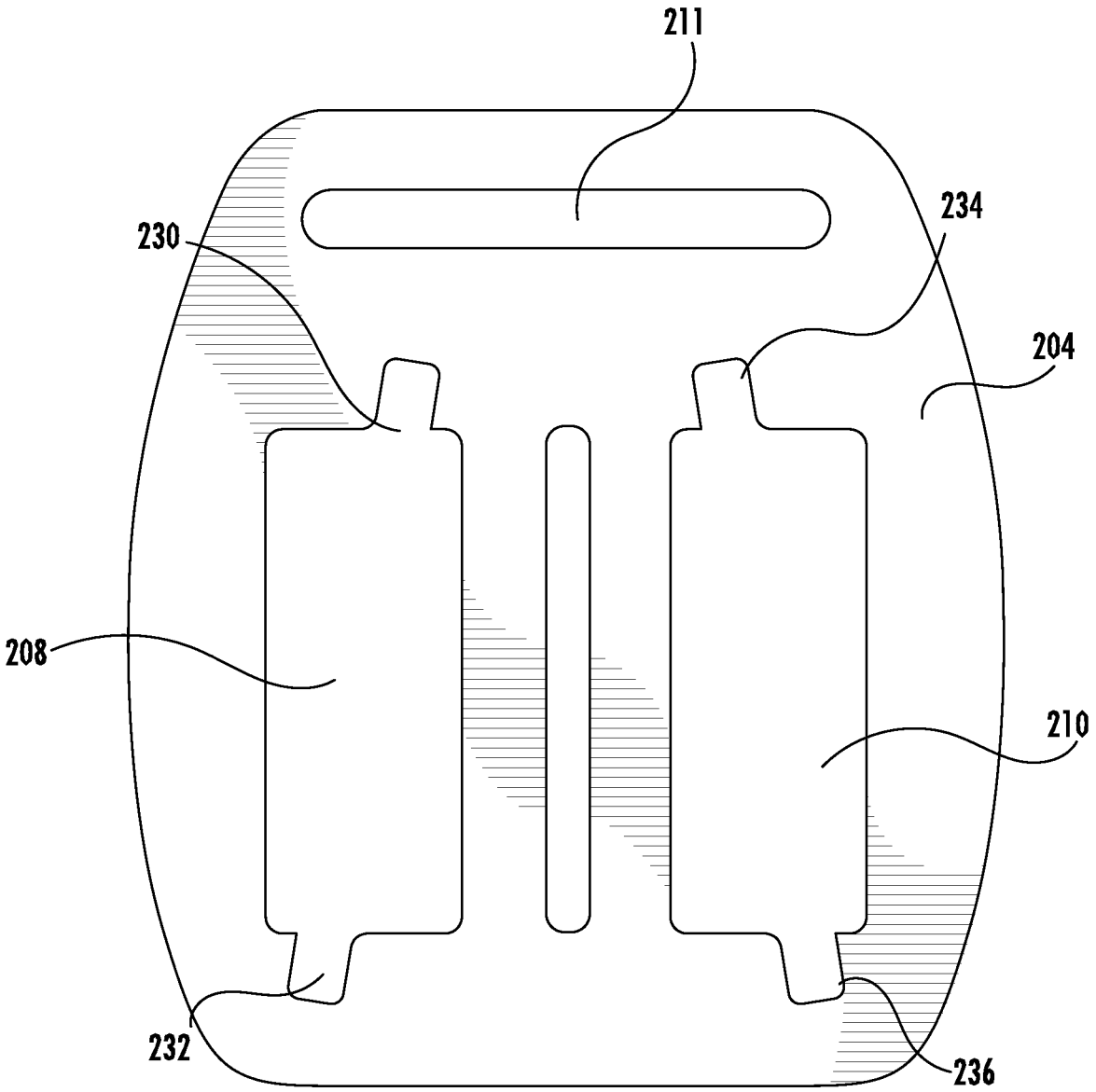
FIG. 2B illustrates an example view of an example apparatus in accordance with various embodiments of the present disclosure.

Referring now to FIG. 2A and FIG. 2B, various example views of an example apparatus in accordance with various embodiments of the present disclosure are shown. In the example shown in FIG. 2A and FIG. 2B, the example apparatus may take the form of an example harness 200. In particular, FIG. 2A illustrates an example partial view of the example harness 200, which may comprise at least the first leg strap 202, a three-way plate 204, and a first thigh strap 206. FIG. 2B illustrates example details of the three-way plate 204.

In some examples, a first end of the first thigh strap 206 may be fastened to a ventral plate 214, similar to those described above in connection with the thigh strap 143 of FIGS. 1A-1C. Additionally, or alternatively, a second end of the first thigh strap 206 may be fastened to the three-way plate 204 through a third slot 211 of the three-way plate 204. For example, the second end of the first thigh strap 206 may comprise a loop that may bond the first thigh strap 206 to the three-way plate 204. Additionally, or alternatively, other fastening mechanisms may be used to fasten the second end of the first thigh strap 206 to the three-way plate 204, such as, but not limited to, through a connector or carabiner.

In the example shown in FIG. 2A, the first leg strap 202 may comprise a first end 216 and a second end 218. In some examples, the first end 216 of the first leg strap 202 may be fastened to the three-way plate 204 through the first slot 208 of the three-way plate 204. For example, the first end 216 of the first thigh strap 206 may pass through the first slot 208, and may be secured on the first leg strap 202 through a retaining device (such as a loop 221). Additionally, or alternatively, the second end 218 of the first leg strap 202 may be fastened to the three-way plate 204 through the second slot 210 of the three-way plate 204, similar to those described above in connection with the first end 216.

In the example shown in FIG. 2B, the three-way plate 204 may comprise material having sturdy characteristics, such as, but not limited to, nickel, brass, zinc, steel, and/or the like. The width of the first slot 208 and the second slot 210 may correspond to the width of the first leg strap 202, such that the first end 216 and the second end 218 may be fastened to the three-way plate 204 as described above. Similarly, the width of the third slot 211 may correspond to the width of the first thigh strap 206, such that the first thigh strap 206 may be fastened to the three-way plate 204 as described above.

In some examples, a length of the first slot 208 may be in a direction that is in a perpendicular arrangement with a direction of a length of the third slot 211. In some examples, a length of the second slot 210 may be in a direction that is in a perpendicular arrangement with a direction of a length of the third slot 211. In some examples, a length of the first slot 208 may be in a direction that is in a parallel arrangement with a direction of a length of the second slot 210.

In some examples, the first slot 208 and/or the second slot 210 may be in a shape similar to a rounded rectangle shape. In the example as shown in FIG. 2B, the first slot 208 and/or the second slot 210 may further comprise one or more projections that may extend outwardly from its rounded rectangle shape. For example, the first slot 208 may comprise a first projection 230 and a second projection 232 that may extend outwardly from the first slot 208. The first projection 230 and the second projection 232 may be diagonal to each other. In some examples, the first projection 230 and the second projection 232 may enable the first end 216 of the first leg strap 202 to pass through and be secured in place. Similarly, the second slot 210 may comprise a third projection 234 and a fourth projection 236 that may extend outwardly from the second slot 210 and may be diagonal to each other.

Referring back to FIG. 2A, the example harness 200 may comprise a second thigh strap 220, and a second leg strap 222 that may be connected to the second thigh strap 220. In some examples, the example harness 200 may comprise a waist belt 224 and a waist pad 226 fastened to the waist belt 224, similar to the waist belt 117 and the waist pad 147 described above in connection with FIGS. 1A-1C. In some examples, the example harness 200 may comprise an abdomen strap 228, similar to the abdomen strap 123 described above in connection with FIGS. 1A-1C.

While FIG. 2A illustrates an example partial view of the example harness 200, it is noted that the example harness 200 may include additional components, such as, but not limited to, a chest strap, a sternal plate, one or more shoulder straps, and/or a back pad, similar to those described above in connection with FIGS. 1A-1C.

In some examples, the three-way plate 204 may replace to need for two separate buckles (such as the leg buckle and the thigh buckle described in connection with FIGS. 1A-1C). For example, when the example harness 200 is not in use, both the first thigh strap 206 and the first end 216 of the first leg strap 202 may be fastened to the three-way plate 204, leaving the second end 218 disconnected from the three-way plate 204. When a user attempts to wear the example harness 200, the user may slip the example harness 200 over his shoulders, connect the first waist buckle plate 219 with the second waist buckle plate 212, and connect the second end 218 to the second slot 210 of the three-way plate 204. As such, the example harness 200 may reduce or eliminate the need for excessive donning, doffing, and/or size adjustment, and may also provide a reduced weight as compared to other harnesses.

Figure 3:
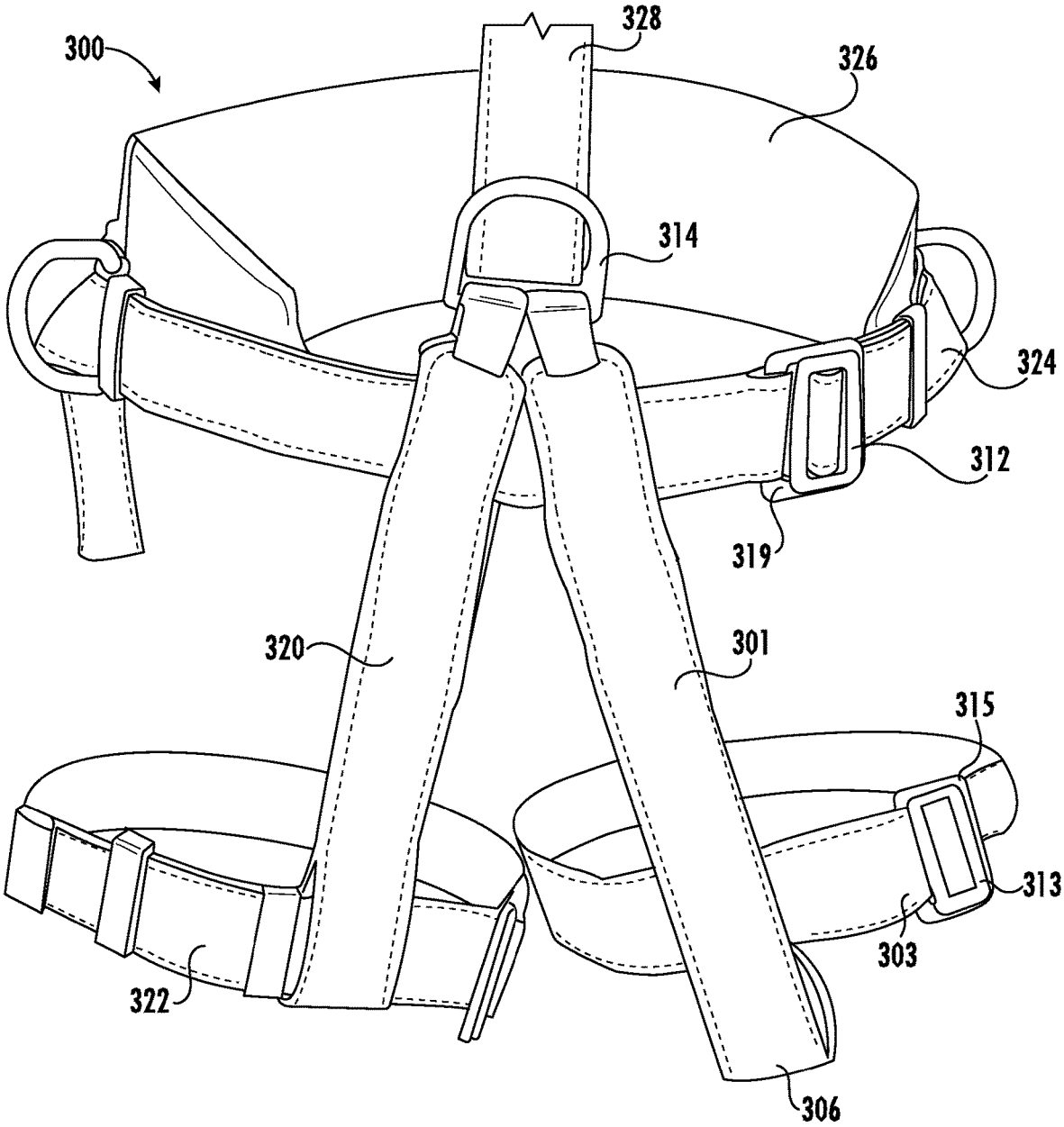
FIG. 3 illustrates an example view of an example apparatus in accordance with various embodiments of the present disclosure.

Referring now to FIG. 3, an example view of an example apparatus in accordance with various embodiments of the present disclosure are shown. In the example shown in FIG. 3, the example apparatus may take the form of an example harness 300. In particular, FIG. 3 illustrates an example partial view of the example harness 300, including at least the first leg strap 303 and a thigh strap 301.

In some examples, a first end of the thigh strap 301 may be fastened to a ventral plate 314, similar to those described above in connection with the thigh strap 143 of FIGS. 1A-1C. In some examples, a second end of the thigh strap 301 may comprise a loop 306.

In some examples, a first end of the first leg strap 303 may be fastened to a first leg buckle plate 313, and a second end of the first leg strap 303 may be fastened to a second leg buckle plate 315. For example, the first leg buckle plate 313 may comprise one or more slots or openings, and a first end of the first leg strap 303 may pass through one or more of the slots or openings and may be stitched back on the first leg strap 303, thereby creating a loop that is bonded to the first leg buckle plate 313. Additionally, or alternatively, the first leg buckle plate 313 may be in other forms, such as those described above. Additionally, or alternatively, other fastening mechanisms may be used to fasten the first end of the first leg strap 303 to the first leg buckle plate 313, such as, but not limited to, through an adhesive material (e.g. fabric glue). In some examples, the second end of the first leg strap 303 may be similarly fastened to the second leg buckle plate 315.

In some examples, the first leg buckle plate 313 and the second leg buckle plate 315 may form a leg buckle that connects the first end and the second end of the first leg strap 303 through the loop 306 of the thigh strap 301. The thigh buckle may be in various forms, including but not limited to, a pass-through buckle, a quick connect buckle, a cam buckle, a roller buckle, and/or a belt buckle as described above.

In the example shown in FIG. 3, the example harness 300 may comprise a second thigh strap 320, and a second leg strap 322 that may be connected to the second thigh strap 320. In some examples, the example harness 300 may comprise a waist belt 324 and a waist pad 326 fastened to the waist belt 324, similar to the waist belt 117 and the waist pad 147 described above in connection with FIGS. 1A-1C. In some examples, the example harness 300 may comprise an abdomen strap 328, similar to the abdomen strap 123 described above in connection with FIGS. 1A-1C.

While FIG. 3 illustrate partial views of the example harness 300, it is noted that the example harness 300 may include additional components, such as, but not limited to, a chest strap, a sternal plate, one or more shoulder straps, and/or a back pad, similar to those described above in connection with FIGS. 1A-1C.

In some examples, when a user attempts to wear the example harness 300, the user may slip the example harness 300 over his shoulders, connect the first waist buckle plate 319 with the second waist buckle plate 312, and connect the first leg buckle plate 313 with the second leg buckle plate 315 through the loop 306 of the thigh strap 301. As such, the example harness 300 may reduce the time needed for donning, doffing, and/or size adjustment as compared to other harnesses.

It is to be understood that the disclosure is not to be limited to the specific embodiments disclosed, and that modifications and other embodiments are intended to be included within the scope of the appended claims. Although specific terms are employed herein, they are used in a generic and descriptive sense only and not for purposes of limitation, unless described otherwise.

The invention claimed is:

1. A harness, comprising:

a first leg strap, wherein the first leg strap comprises a first elongated member configured to be placed around a leg portion of a wearer;

a lower strap, wherein the lower strap comprises a second elongated member, wherein a first end of the second elongated member is fastened to a first side of the first elongated member, wherein a second end of the second elongated member is fastened to a first thigh buckle plate through a slot of the first thigh buckle plate; and an upper strap, wherein the upper strap comprises a third elongated member, wherein a first end of the third elongated member is fastened to a ventral plate through a first slot of the ventral plate, wherein a second end of the third elongated member is fastened to a second thigh buckle plate through a slot of the second thigh buckle plate, wherein the first thigh buckle plate and the second thigh buckle plate form a thigh buckle connecting the upper strap and the lower strap, wherein the upper strap comprises a loop at the first end of the third elongated member; and a waist belt comprising a fourth elongated member, wherein a first end of the fourth elongated member is fastened to a first waist buckle plate through a slot of the first waist buckle plate, wherein a second end of the fourth elongated member is fastened to a second waist buckle plate through a slot of the second wait buckle plate, wherein the first waist buckle plate and the second waist buckle plate form a waist buckle connecting the first end and the second end of the fourth elongated member through the loop of the upper strap so that the waist buckle is on the same side of the wearer as the thigh buckle when the harness is donned by the wearer.

2. The harness of claim 1, wherein the thigh buckle comprises a pass-through buckle.

3. The harness of claim 1, wherein a first end of the first elongated member is fastened to a first leg buckle plate through a slot of the first leg buckle plate, wherein a second end of the first elongated member is fastened to a second leg buckle plate through a slot of the second leg buckle plate, wherein the first leg buckle plate and the second leg buckle plate form a leg buckle connecting the first end and the second end of the first elongated member.

4. The harness of claim 1, further comprising:

an abdomen strap, wherein the abdomen strap comprises a fifth elongated member, wherein a first end of the fifth elongated member is fastened to the ventral plate through a second slot of the ventral plate, wherein a second end of the fifth elongated member is fastened to a sternal plate through a first slot of the sternal plate.

5. The harness of claim 4, further comprising:

a chest strap, wherein the chest strap comprises a sixth elongated member passing through a second slot of the sternal plate, wherein a first end of the sixth elongated member is fastened to a first shoulder buckle plate through a slot of the first shoulder buckle plate, wherein a second end of the sixth elongated member is fastened to a second shoulder buckle plate through a slot of the second shoulder buckle plate.

6. The harness of claim 5, further comprising:

a first shoulder strap, wherein the first shoulder strap comprises a seventh elongated member, wherein a first end of the seventh elongated member is fastened to a third shoulder buckle plate through a slot of the third shoulder buckle plate, wherein a second end of the seventh elongated member is fastened to the first elongated member, wherein the first shoulder buckle plate and the third shoulder buckle plate form a first shoulder buckle connecting the chest strap and the first shoulder strap.

7. The harness of claim 6, further comprising:

a second leg strap, wherein the second leg strap comprises an eighth elongated member; and a second shoulder strap, wherein the second shoulder strap comprises a ninth elongated member, wherein a first end of the ninth elongated member is fastened to a fourth shoulder buckle plate through a slot of the fourth shoulder buckle plate, wherein a second end of the ninth elongated member is fastened to the eighth elongated member, wherein the second shoulder buckle plate and the fourth shoulder buckle plate form a second shoulder buckle connecting the chest strap and the second shoulder strap.

8. A harness, comprising:

a three-way plate, wherein the three-way plate comprises a first slot, a second slot, and a third slot;

a first leg strap, wherein the first leg strap comprises a first elongated member configured to be placed around a leg portion of a wearer, wherein a first end of the first elongated member is fastened to the three-way plate through the first slot, wherein a second end of the first elongated member is fastened to the three-way plate through the second slot;

a thigh strap, wherein the thigh strap comprises a second elongated member, wherein a first end of the second elongated member is fastened to a ventral plate through a first slot of the ventral plate, wherein a second end of the second elongated member is fastened to the three-way plate through the third slot of the three-way plate; and wherein the thigh strap comprises a loop at the first end of the second elongated member; and a waist belt, wherein the waist belt comprises a third elongated member, wherein a first end of the third elongated member is fastened to a first waist buckle plate through a slot of the first waist buckle plate, wherein a second end of the third elongated member is fastened to a second waist buckle plate through a slot of the second wait buckle plate, wherein the first waist buckle plate and the second waist buckle plate form a waist buckle connecting the first end and the second end of the third elongated member through the loop of the upper strap so that the waist buckle is on the same side of the wearer as the thigh buckle when the harness is donned by the wearer.

* * * * *